US007552835B2

(12) United States Patent
Kiel et al.

(10) Patent No.: US 7,552,835 B2
(45) Date of Patent: Jun. 30, 2009

(54) MULTIPLE PACK AND METHOD OF PRODUCING SAME

(75) Inventors: Hans-Richard Kiel, Oyten (DE); Uwe Nehus, Verden (DE); Bernard De Turckheim, Olivet (FR)

(73) Assignee: Mars Incorporated, McLean, VA (US)

( * ) Notice: Subject to any disclaimer, the term of this patent is extended or adjusted under 35 U.S.C. 154(b) by 780 days.

(21) Appl. No.: 10/503,001

(22) PCT Filed: Jan. 13, 2003

(86) PCT No.: PCT/EP03/00214

§ 371 (c)(1),
(2), (4) Date: Jan. 27, 2005

(87) PCT Pub. No.: WO03/064282

PCT Pub. Date: Aug. 7, 2003

(65) Prior Publication Data

US 2005/0115204 A1 Jun. 2, 2005

(30) Foreign Application Priority Data

Jan. 30, 2002 (DE) ..... 102 03 448

(51) Int. Cl.
*A47G 19/00* (2006.01)
*B65D 21/02* (2006.01)

(52) U.S. Cl. ..... 220/23.8; 220/23.4; 53/467

(58) Field of Classification Search ..... 220/23.2, 220/23.4, 23.6, 23.8, 522; 53/425, 443, 467, 53/474, 155; 426/119, 120
See application file for complete search history.

(56) References Cited

U.S. PATENT DOCUMENTS

| | | | | | |
|---|---|---|---|---|---|
| 3,945,170 | A | * | 3/1976 | Brown | 53/428 |
| 4,339,033 | A | * | 7/1982 | Cillario | 206/216 |
| 4,513,015 | A | | 4/1985 | Clough | |
| 4,844,251 | A | | 7/1989 | Gueret | |
| 5,843,501 | A | * | 12/1998 | Rubin et al. | 426/127 |

FOREIGN PATENT DOCUMENTS

| | | | |
|---|---|---|---|
| DE | 299 08 952 | | 9/1999 |
| EP | 0 677 454 | | 10/1995 |
| FR | 2 642 726 | | 8/1990 |
| GB | 2242410 | A * | 10/1991 |
| GB | 2297536 | | 8/1996 |

* cited by examiner

*Primary Examiner*—Anthony D Stashick
*Assistant Examiner*—Harry A Grosso
(74) *Attorney, Agent, or Firm*—Fulbright & Jaworski LLP

(57) ABSTRACT

Method of producing a multiple pack subdivided into at least two chambers separate from one another and each containing a product, characterized in that a first pack element having at least one chamber containing a first product is subjected to a first treatment process and is sealed, either previously or subsequently, and a second pack element having at least one chamber containing a second product is subjected to a second treatment process, which is different from the first, and is sealed, either previously or subsequently, and that the two pack elements are assembled into one unit to form the multiple pack.

20 Claims, 1 Drawing Sheet

MULTIPLE PACK AND METHOD OF PRODUCING SAME

CROSS-REFERENCE TO RELATED APPLICATIONS

This application is a national stage application of PCT/EP03/00214 filed Jan. 13, 2003 claiming priority to DE 10203448.6 filed Jan. 30, 2002.

TECHNICAL FIELD

The invention relates to a method of producing a multiple pack subdivided into at least two chambers separate from one another and each containing a product. The invention further relates to a multiple pack with at least two chambers separate from one another and each containing a product, where the multiple pack has been produced in accordance with the method of the invention.

BACKGROUND OF THE INVENTION

In conventional multiple packs, e.g. in the form of bowls subdivided into a plurality of compartments or chambers, the manufacturing process leads to problems, when the compartments are filled with different products, if the respective properties of the different products mean that they are subjected to production or treatment processes which are basically different or that they would have to be managed or handled differently in some other way even though this is difficult or impossible because of the fact that the individual products are located in one and the same multiple bowl or multiple pack. So far, it has been tolerated that different products are treated uniformly and thus not ideally, so that in the case of a multiple pack containing a ready-made meal for example, the different components, e.g. vegetables and meat, are cooked for the same length of time and thus not ideally.

The object of the invention is to provide a method of producing a multiple pack with which the above-mentioned problems can be overcome.

BRIEF SUMMARY OF THE INVENTION

This object is achieved, in accordance with the invention, by a method of producing a multiple pack subdivided into at least two chambers separate from one another and each containing a product, characterized by the fact that, in a first step, a first pack element having at least one first chamber for receiving at least one first product is filled with at least one first product in a first process, in a second step a second pack element with at least one second chamber for receiving at least one second product is filled with at least one second product in a second process, which is different from the first process, and in a third step the two pack elements are assembled into one unit to form the multiple pack and are joined together, either releasably or non-releasably, the chambers of the pack elements being sealed before or after the third step.

It is conveniently provided for the first process to be different from the second process with regard to at least one process characteristic or one process parameter, especially sterility, temperature or temperature development, pressure or pressure development, intensity of any irradiation (visible or invisible light, high-energy electromagnetic radiation), blending of additives, handling steps, or transport speed.

It can be provided for at least one of the processes to involve a preservation or sterilization step.

It is preferably provided for at least one chamber of a pack element to be sealed before the completion of the process concerned.

It is preferably provided for the chamber concerned to be sealed such that it is diffusion-tight during the preservation or sterilization step.

It can be provided for at least one chamber of a pack element to be sealed with a closure film.

In a second appropriate embodiment, two pack elements are provided with one chamber each.

In a further development of the invention, it can be provided for the pack elements to engage with one another, and/or to be bonded and/or welded together.

It is preferably provided for the multiple pack to be sealed, after the pack elements have been joined together, with a closure film covering all the pack elements. In the process, it can also be provided for the closure film to serve at the same time as a means of sealing one of the pack elements. In this context, it can in particular be provided for at least one of, preferably all, the pack elements to be sealed with sealing films and for the closure film also to be sealed with the sealing films of the pack elements, so that, when the closure film is opened, the sealing films of all the pack elements can be opened in a single step.

The object of the invention is further achieved by a multiple pack with at least two chambers separate from one another and each containing a product, wherein the multiple pack is produced according to the method of the invention, and it can in particular be provided for a second pack element to be designed as a bowl pack with a receptacle for a first, especially bowl-shaped pack element. In this context, it can be provided for the second pack element to be of a freely chosen shape, in particular round, polygonal or substantially rectangular, and to have a receptacle opening of a freely chosen shape, in particular round, polygonal or substantially rectangular, to receive the first pack element which is to be placed in it and which is also of a freely chosen shape, in particular round, polygonal or substantially rectangular.

It is preferably provided for the chambers to have volumes in a ratio of 1:1 to 1:10, in particular up to 1:4.

BRIEF DESCRIPTION OF THE DRAWINGS

The invention will now be explained by means of a working embodiment, with reference being made to a drawing in which.

DETAILED DESCRIPTION OF THE INVENTION

Figure 1:
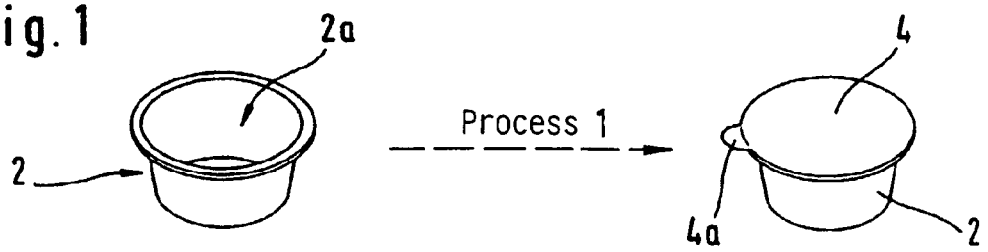
FIGS. 1 and 2 illustrate the two different processes.

FIGS. 1 to 4 show schematically, from top to bottom, major production steps for a multiple pack in accordance with the invention, which is illustrated at the bottom right of the drawing and is designated as a whole by reference numeral 10.

FIG. 1 shows a first pack element 2, which in principle can be of any freely chosen shape (e.g. round, polygonal or square in layout) and in the present case is in the shape of a round bowl, tapering into a slightly conical shape at the bottom, with a first chamber 2*a*. In a (first) process 1, which can be a filling, handling, transport, treatment and/or other process, the bowl 2 is filled with a product, e.g. a(n) (animal) food product and, at any convenient time, e.g. at the end of the process or before a particular treatment step, sealed with a first sealing film 4. It can, for example, be provided for the bowl 2 with the product contained therein to undergo a sterilization or preservation process, during which the product is exposed to a sterilization temperature of 120 to 130° C. over a period of about 30 to 60 minutes.

Alternatively, the process 1 could consist merely in a particular step of handling or transporting the bowl, connected with filling with a desired product, without any particular treatment occurring. The bowl might, for example, merely be filled with a product under sterile or aseptic conditions and subsequently sealed. The essential feature is only that the bowl 2 and the product to be placed therein should be capable of being handled and optionally treated or processed independently of one or more other pack elements and products.

Figure 2:
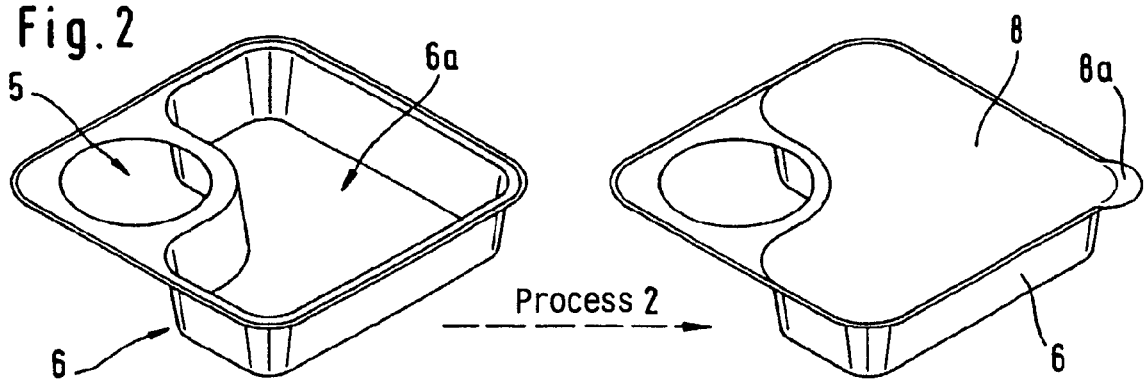

FIG. 2 shows a second pack element 6 with a second chamber 6*a* for receiving a product, and again said second pack element 6 can in principle also be of any freely chosen shape and in the present example is designed as a square bowl with a receptacle opening 5 for the first pack element 2. The second pack element 6 undergoes a (second) process 2 and is filled with a product, e.g. a(n) (animal) food product, and is sealed with a second sealing film 8, also that, by analogy with the process 1, the filled, optionally treated and sealed pack element 6 is left at the end of the process 2. In the case of process 2 as well, any desired handling, filling, treatment and/or other steps can be provided, the sealing of the pack element 6 being performed at any convenient point of the process. The process 2 can, for example, consist of or include a sterilization or preservation process, or it might be a cooking process. Here too, the essential feature is that process 2 takes place independently of process 1, i.e. the pack element 6 can be handled, filled and treated etc. independently of the pack element 2, and that the two processes differ from one another in at least one process parameter. This might be a different process step or also a different physical parameter (temperature, pressure, duration etc.). The sealing films 4, 8 are made of a material which, as far as possible, is diffusion-tight even under the conditions prevailing during the various treatment processes (metallized plastics, metal films or the like). Opening tabs 4*a*, 8*a* facilitate lifting the films later.

Figure 3:
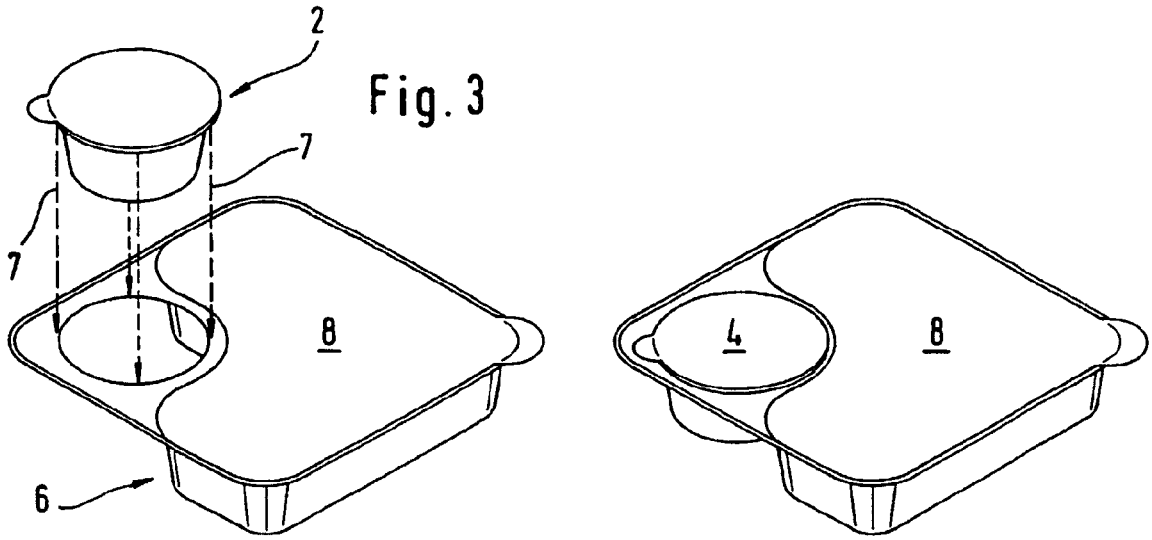
FIG. 3 shows the assembly of the multiple pack.

FIG. 3 shows how the two pack elements 2 and 6 are assembled after completion of the two processes and joined together into a unit, so that a single multiple pack is formed, which can be handled (transported, stored, sold etc.) as a unit. It is convenient for the first pack element 2, as in the present example, to be inserted into a corresponding receptacle opening 5 of the second pack element 6 (arrows 7). The two pack elements are fixed to one another, e.g. by means of a firm fit (press fit), engaging, welding, bonding, sealing etc.

Figure 4:
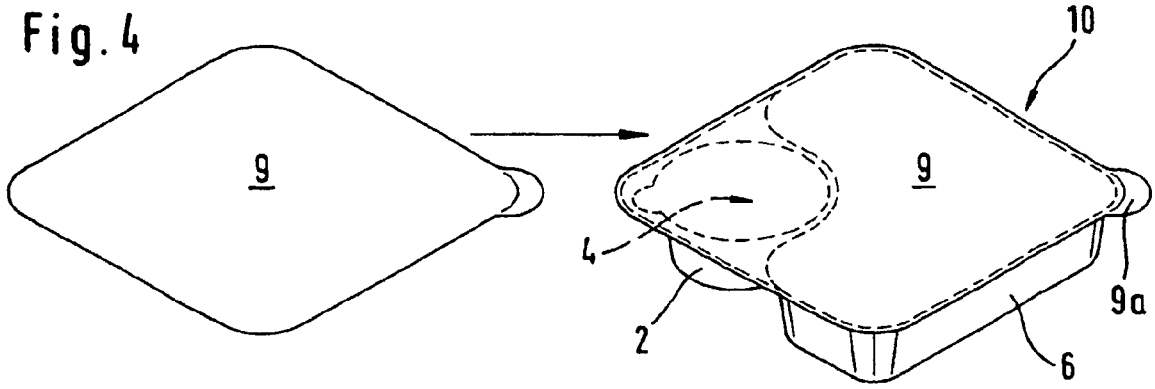
FIG. 4 shows the attachment of a closure film.

As FIG. 4 shows, this example involves a further step, in which a closure film 9 covering the two pack elements is applied, which in the present example is rectangular or square and is sealed onto the rims of the second pack element. In order to improve handling when opening, it can in addition be provided for the closure film 9 to be firmly sealed to the edges of one or both sealing films 4 and 8 respectively, so that when the closure film 9 is opened (opening tab 9*a*) the two pack elements or bowls 2, 6 can be opened at the same time in one go. If the content of bowl 2 is to be emptied into bowl 6 after opening, in order, for example, to mix the two contents together, this can be done in one embodiment by removing bowl 2. On the other hand, it is also possible to provide notches, perforations or weakened lines in the region around the receptacle opening 5, in order to facilitate folding this region (including bowl 2) over bowl 6.

As a rule, it will be provided for the individual pack elements of the multiple pack to be sealed during or at the end of processes 1 and 2. Alternatively, however, it can also be provided for the pack elements to be assembled in an unsealed state and only when assembled to be sealed with one or more films. In this case, the film 9 may replace one or optionally even both individual films 4, 8.

The decisive advantage of the method of the invention consists in the fact that two or more product components of a multiple pack can be subjected to different handling, treatment or manufacturing processes, in which they are exposed to different process parameters and can be handled separately from one another before finally being assembled into a single multiple pack.

What is claimed is:

1. A method of producing a multiple pack subdivided into at least two chambers separate from one another and each containing a product, the method comprising:

in a first step, a first pack element having at least one first chamber for receiving at least one first product is filled with at least one first product in a first process in which the first process includes a first treatment step comprising a sterilization step or a preservation step that takes place within the at least one first chamber;

in a second step, a second pack element with at least one second chamber for receiving at least one second product is filled with at least one second product in a second process in which the second process includes a second treatment step comprising a sterilization step, a preservation step or a cooking step that takes place within the at least one second chamber; and in a third step, the two pack elements are assembled into one unit to form the multiple pack and are joined together, either releasably or non-releasably, the chambers of the pack elements being sealed before or after the third step;

wherein the process of the second treatment step is different from the process of the first treatment step.

2. The method as claimed in claim 1, wherein the first process is different from the second process with regard to one or more process characteristic or process parameter selected from the group consisting of sterility, temperature, temperature development, pressure, pressure development, intensity of any irradiation, blending of additives, handling steps and transport speed.

3. The method as claimed in claim 1, wherein at least one of the processes involves a preservation step, a sterilization step a or cooking step.

4. The method as claimed in claim 1, wherein at least one chamber of a pack element is sealed before the completion of the process concerned.

5. The method as claimed in claim 3, wherein the chamber concerned is sealed such that it is diffusion-tight during the preservation or sterilization step.

6. The method as claimed in claim 1, wherein at least one chamber of a pack element is sealed with a sealing film.

7. The method as claimed in claim 1, wherein there are two pack elements with one chamber each.

8. The method as claimed in claim 1, wherein the pack elements engage with one another.

9. The method as claimed in claim 1, wherein the multiple pack is sealed, after the pack elements have been joined together, with a closure film covering all the pack elements.

10. The method as claimed in claim 9, wherein the closure film serves at the same time as a means of sealing one of the pack elements.

11. The method as claimed in claim 9, wherein at least one of the pack elements are sealed with sealing films and the closure film is sealed together with the sealing films of the pack elements, so that, when the closure film is opened, the sealing films of all the pack elements can be opened in a single step.

12. A multiple pack with at least two chambers separate from one another and each containing a product, manufactured in accordance with the method comprising:

in a first step, a first pack element having at least one first chamber for receiving at least one first product is filled with at least one first product in a first process in which the first process includes a first treatment step comprising a sterilization step or a preservation step that takes place within the at least one first chamber;

in a second step a second pack element with at least one second chamber for receiving at least one second product is filled with at least one second product in a second process in which the second process includes a second treatment cooking step that takes place within the at least one second chamber; and in a third step the two pack elements are assembled into one unit to form the multiple pack and are joined together, either releasably or non-releasably, the chambers of the pack elements being sealed before or after the third step wherein the the process of the second treatment step is different from the process of the first treatment step.

13. The multiple pack as claimed in claim 12, wherein a second pack element is designed as a bowl pack with a receptacle for a first bowl-shaped pack element.

14. The multiple pack as claimed in claim 13, wherein the second pack element has a shape selected from a group consisting of a round, polygonal and square in layout and has a receptacle opening of corresponding to the shape of second pack element, to receive the first pack element which is to be placed in it and which has a shape selected from a group consisting of a round, polygonal and square in layout.

15. The multiple pack as claimed in claim 12, wherein the chambers have volumes in a ratio of 1:1 to 1:10.

16. The method as claimed in claim 2, wherein the intensity of any irradiation is selected from a group consisting of visible light, invisible light and high-energy electromagnetic radiation.

17. The method as claimed in claim 9, wherein all of the pack elements are sealed with sealing films and the closure film is sealed together with the sealing films of the pack elements, so that, when the closure film is opened, the sealing films of all the pack elements can be opened in a single step.

18. The multiple pack as claimed in claim 14, wherein the shape of the second pack element, the receptacle opening and the first pack element is selected from a group consisting of round, polygonal and substantially rectangular.

19. The multiple pack as claimed in claim 15, wherein the chambers have volumes in a ratio of 1:4.

20. The method as claimed in claim 1, wherein the pack elements are bonded or welded together.

* * * * *